US005230776A

United States Patent [19]

Andersson et al.

[11] Patent Number: 5,230,776

[45] Date of Patent: Jul. 27, 1993

[54] PAPER MACHINE FOR MANUFACTURING A SOFT CREPE PAPER WEB

[75] Inventors: Ingmar A. Andersson, Hammaro; Cai O. Hellner, Ed, both of Sweden

[73] Assignee: Valmet Paper Machinery, Inc., Helsingfors, Finland

[21] Appl. No.: 914,199

[22] Filed: Jul. 14, 1992

Related U.S. Application Data

[63] Continuation of Ser. No. 678,944, Apr. 16, 1991, abandoned.

[30] Foreign Application Priority Data

Oct. 25, 1988 [SE] Sweden ..... 8803810.4

[51] Int. Cl.[5] ..... D21F 9/00

[52] U.S. Cl. ..... 162/290; 162/301; 162/305; 162/359.1; 162/279

[58] Field of Search ..... 162/113, 116, 206, 359.1, 162/279, 290, 301, 360.3

[56] References Cited

U.S. PATENT DOCUMENTS

| | | | |
|---|---|---|---|
| 3,301,746 | 1/1967 | Sanford et al. | 162/113 |
| 3,694,311 | 9/1972 | Steppstedt | 162/359 |
| 3,891,500 | 6/1975 | Kankaanpaa | 162/359 |
| 4,144,124 | 3/1979 | Turunen et al. | 162/359 |
| 4,309,246 | 1/1982 | Hulit et al. | 162/205 |
| 4,529,480 | 7/1985 | Trokhan | 162/109 |
| 4,888,096 | 12/1989 | Cowan et al. | 162/358 |

FOREIGN PATENT DOCUMENTS 2641714 6/1981 Fed. Rep. of Germany .

*Primary Examiner*—Karen M. Hastings
*Attorney, Agent, or Firm*—Bell, Seltzer, Park & Gibson

[57] ABSTRACT

A paper machine for manufacturing a soft crepe paper web, comprising a wet end (1) having a forming wire (4) for forming and carrying a paper web (7), and a drying section (2) provided with a drying cylinder (12), said paper machine having a first operating arrangement for manufacturing a soft crepe paper web with certain bulk and softness values, in which first operating arrangement the drying section has a felt (13) arranged to run in a loop from a pick-up roll (14) at the transition between the wet end and drying section, to a press roll (15) at the drying cylinder, and the carrying forming wire runs up to the pick-up roll (14) to transfer the paper web to the felt (13). According to the invention the paper machine is rebuildable between said first operating arrangement and a second operating arrangement for the production of a soft crepe paper web having higher bulk and softness values in relation to the first operating arrangement and in which second operating arrangement the carrying forming wire (4a) runs up to the press roll (15). Said felt is replaced by a belt (25) of wire type, movable in a loop from the pick-up roll (14) to the press roll in contact with the carrying forming wire (4a), while enclosing the paper web therebetween in order to form a sandwich structure. Means (29–31) producing jets of air are arranged along the sandwich structure to remove water from the paper web (7). Further cleaning means (33–36, 38) are disposed along the belt (25) to clean it so that the permeability to water and air is maintained.

10 Claims, 3 Drawing Sheets

PAPER MACHINE FOR MANUFACTURING A SOFT CREPE PAPER WEB

This application is a continuation of application Ser. No. 07/678,944, filed on Apr. 16, 1991.

The present invention relates to a paper machine for manufacturing a soft crepe paper web, comprising a wet end having at least one forming wire for forming and carrying a paper web, and a drying section provided with a drying cylinder in which the paper web is dried, said paper machine having a first operating arrangement for manufacturing a soft crepe paper web with certain bulk and softness values, in which first operating arrangement the drying section is provided with a felt movable in a loop and arranged to run from a pick-up means at the transition between wet end and drying section, to a press roll which defines a nip with the drying cylinder, said felt carrying the paper web on its lower surface, and the carrying forming wire being arranged to run up to said pick-up means in the drying section to transfer the paper web formed to said felt.

The soft crepe paper web produced in a conventional paper machine of the type described in the introduction, for instance, has certain upper limited values for bulk and softness. To achieve bulk and/or softness values above these limited values special methods have been utilized, such as mixing in expendable microspheres of thermoplastic material as described in U.S. Pat. No. 4,619,734, or utilizing machines which operate with through drying see, for instance, U.S. Pat. No. 3,303,576, U.S. Pat. No. 3,812,000, U.S Pat. No. 3,821,068 and U.S. Pat. No. 4,036,684 in which the through drying is performed on cylinders with perforated outer surface, which may be covered by a fabric for instance, hot drying air being supplied internally and passing out through the cylindric surface, or in the reverse direction.

U.S. Pat. No. 4,144,124 describes a twin wire machine for manufacturing a soft crepe paper web wherein the carrying forming wire extends up to and beyond a press roll from which the paper web is transferred to a yankee cylinder, the press roll being wrapped by a loop of felt and possibly also an embossing wire.

GB 602,237 relates to a fourdrinier machine for manufacturing a soft crepe paper web wherein the formed paper web is transferred to a pick-up felt running in a loop between the fourdrinier former and the roll which may consist of a press roll pressing against a yankee cylinder, the under side of the paper web carried by the pick-up felt being covered by a covering felt running in a loop.

However, said twin wire machine and fourdrinier machine for manufacturing soft crepe paper webs are so constructed that they cannot easily be altered to different operating arrangements in order to produce soft crepe paper webs of different qualities with respect to bulk and softness.

The object of the present invention is to eliminate the problem mentioned above and to provide a paper machine for manufacturing a soft crepe paper web which can easily be altered for adaptation to varying conditions on the market, such as the competitive situation and to accommodate consumer wishes.

The novelty of the invention lies substantially in that the paper machine is rebuildable between said first operating arrangement and a second operating arrangement for the production of a soft crepe paper web having higher bulk and softness values in relation to the first operating arrangement and in which second operating arrangement the carrying forming wire is arranged to run in an extended loop from the wet end to the press roll of the drying section, that the felt of the drying section is replaced by a perforated belt of wire type, movable in a loop and permeable to air and liquid, which is arranged to travel from said pick-up means to said press roll in contact with the extended carrying forming wire while enclosing the paper web therebetween in order to form a continuous sandwich structure, that means producing jets of air are arranged along the sandwich structure to remove water from the paper web by means of air flowing through the paper web, and that cleaning means are arranged along the loop of the belt to clean it so that the permeability to water and air is maintained.

BRIEF DESCRIPTION OF THE DRAWINGS

The invention will be described further in the following with reference to the drawings, in which.

DETAILED DESCRIPTION

Figure 1:
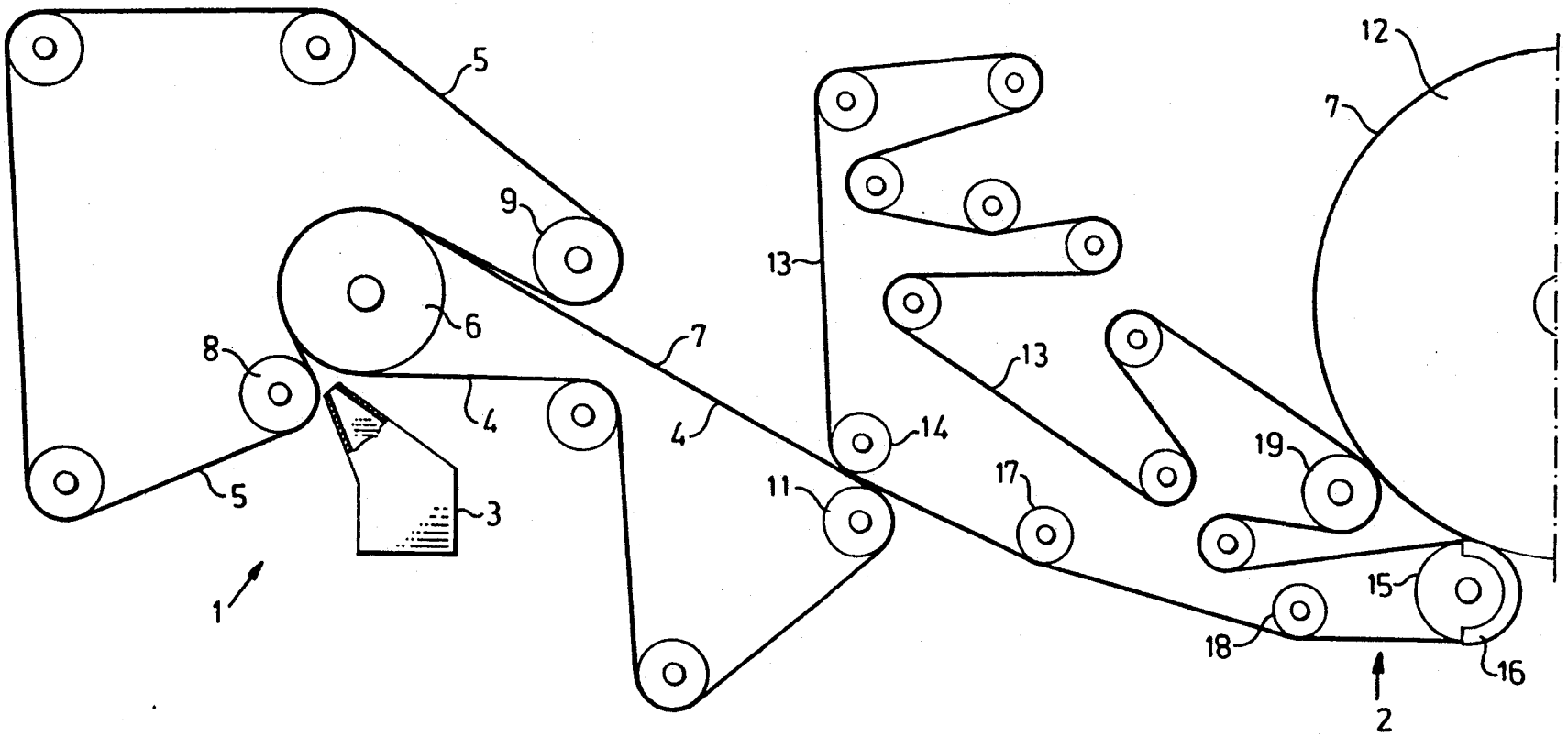
Fig. 1 (PRIOR ART)
FIG. 1 shows schematically a paper machine for manufacturing a soft crepe paper web in a first conventional operating arrangement.

With reference to FIG. 1, it is schematically shown therein parts of a conventional paper machine suitable for the manufacture of a soft crepe paper web such as tissue and other sanitary paper products. The paper machine shown is a twin wire machine comprising a wet end 1 and a dry section 2. The wet end includes a headbox 3, a movable carrying forming wire 4, a movable covering forming wire 5 and a forming roll 6 which may be perforated and provided with suction means. Alternatively, the forming roll may be smooth. The headbox 3 supplies a single or multi-layer flow of stock between the two moving forming wires 4, 5 for forming a paper web 7 by dewatering the stock. The two forming wires 4, 5 run together over the forming roll 6 and then in individual loops over a plurality of rolls arranged to impel, guide, align and stretch the carrying forming wire 4 and the covering forming wire 5. The rolls defining the path of the covering forming wire 5 include a breast roll 8 and, a short way after the forming roll 6, a guide roll 9 which can be termed a forward drive roll. The covering forming wire 5 leaves the carrying forming wire 4 and the paper web 7 either immediately before the wire 4 and paper web 7 diverge from the forming roll 6, or at a transfer suction box, not shown, or other transfer means located between forming roll 6 and forward drive roll 9. The carrying forming wire 4 runs to the drying section 2 where it leaves the paper web 7 by changing its direction of travel around a guide roll 11.

The drying section 2 comprises a drying cylinder 12 having relatively large diameter and a polished cylindric surface. The drying cylinder 12, preferably consisting of a yankee cylinder, is covered by a hood (not shown), in which hot air is blown at high speed against the paper web 7. The paper web is creped from the yankee cylinder 12 by means of a creping doctor (not shown) to obtain the desired creping, after which the finished creped paper web is wound onto a roll. Further, the drying section 2 includes a felt 13 disposed upstream of the yankee cylinder 12 and travelling in a loop around several rolls and around a pick-up means, suitably in the form of a roll 14, located nearest the wet end 1 and thereby in the vicinity of said guide roll 11 for the carrying forming wire 4, and a press roll 15 which presses against the yankee cylinder 12 and is provided with suction means 16 to dewater the paper web before the latter comes into contact with the yankee cylinder 12. The pick-up means may alternatively consist of a shoe. Further, two guide rolls 17, 18 are disposed between the pick-up roll 14 and press roll 15, said guide rolls 17, 18 deflecting with a small angle the direction of travel of the felt 13. A blind-drilled roll 19 is disposed after the press roll 15, in contact with the yankee cylinder. The paper web 7 is transferred to the felt 13 at the point where this and the carrying forming wire 4 converge at the pick-up roll 14 and thereafter immediately diverge from each other. Suitable conditioning means (not shown) are disposed along the loop of the felt 13 in order to condition the felt prior to contact with the paper web.

Figure 2:
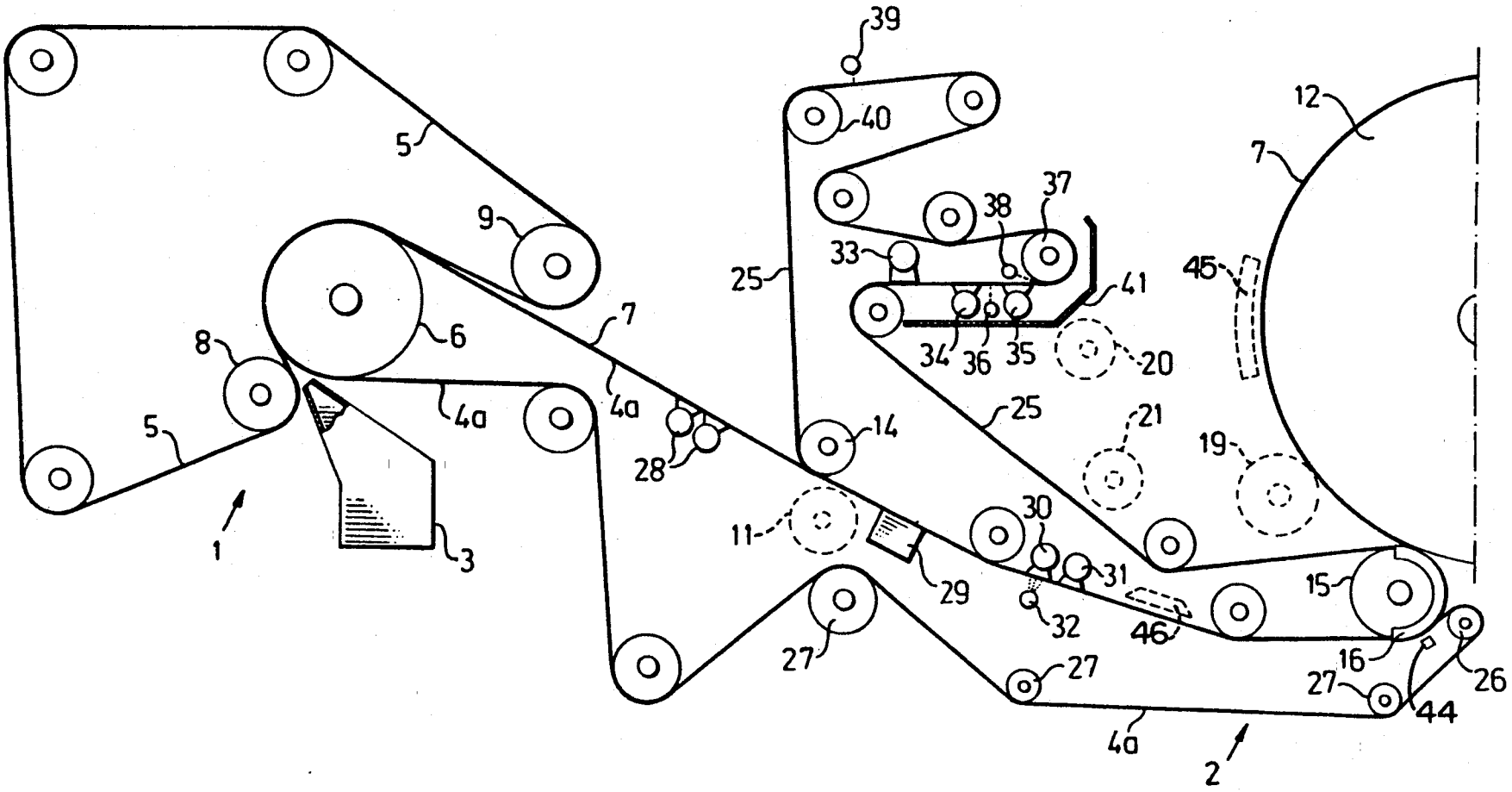
FIG. 2 shows schematically the paper machine according to FIG. 1 in a second, rebuilt operating arrangement in accordance with the present invention.

FIG. 2 shows schematically the same paper machine as that according to FIG. 1 with respect to its basic structure, but supplemented and modified in accordance with the present invention, enabling it to be rebuilt between a first operating arrangement according to FIG. 1 and a second operating arrangement according to FIG. 2. Modification to the second operating arrangement substantially consists of removing the felt 13 and replacing it with an endless, perforated belt 25 of wire type, permeable to air and liquid, and of extending the carrying forming wire 4*a* up to the yankee cylinder 12 to that it travels in a larger loop with respect to said first operating arrangement and over a predetermined sector of the press roll 15. The carrying forming wire 4*a* travels in contact with the belt 25 from the pick-up roll 14 to the press roll 15, encasing the paper web 7 between itself and the belt 25 as an intermediate layer for forming a continuous sandwich structure that is maintained up to the press roll 15.

A guide roll 26 is disposed in the larger loop of the carrying forming wire 4*a*, after and spaced from the point where the belt 25 first encounters the press roll 15, so that the carrying forming wire 4*a* travels around said predetermined sector of the press roll 15, this being sufficient for the paper web to be transferred to the belt with the aid of suction means 16 inside the press roll 15, said suction means being disposed within said sector and up to the nip defined by the press roll 15 and yankee cylinder 12. Further, additional rolls 27 are disposed within and outside the larger loop of the carrying forming wire 4*a* in order to guide and stretch it. The previously mentioned guide roll 11 is not used in this modified second operating arrangement.

No extra rolls are required for installation of the belt 25. Instead, the loop can be made shorter in relation to the felt 13 used previously, since the roll 19 is superfluous, and thus also the two guide rolls 20, 21 in the vicinity thereof.

Suction boxes 28 may be mounted before the guide roll 14 where the paper web 7 thus is exposed. (Such suction boxes may also be used in the first operating arrangement.) The paper web can hence be dewatered to a dry solids content of up to a maximum of 25%. By extending the carrying forming wire 4*a* as described, and allowing this to cooperate with an open belt 25 of wire type, which has equal or substantially equal permeability to water and air as the forming wire 4*a*, in order to encase the paper web therebetween to form a continuous sandwich structure as described, it is not possible to arrange additional dewatering means producing jets of air, along this sandwich structure in order to further increase the dry solids content before the yankee cylinder. In the modified operating arrangement of the paper machine shown in FIG. 2 these means comprise a suction box 29 disposed on the under side of the sandwich structure immediately after the guide roll 14, and a pair of suction boxes 30, 31 disposed on the upper side of the sandwich structure downstream of the lower suction box 29, a steam blowing tube 32 being disposed on the other side of the sandwich structure, opposite the suction box 30. Further, a blowing nozzle 44 may be disposed at the press roll 15 in the loop for the forming wire 4*a*, opposite said sector of the press roll 15 where a part of the suction means 16 is thus located. Moreover, cleaning means are also disposed at one or more points between the press roll 15 and the pick-up roll 14, seen in the direction of movement of the belt, to clean thoroughly the belt to ensure that its permeability to water and air is continuously maintained. In the embodiment shown these cleaning means comprise a water spray tube 33 disposed inside the loop and two suction boxes 34, 35 and an oscillating high pressure spray tube 36 disposed between the suction boxes outside the loop, immediately downstream of said water spray tube 33. Further, a water spray tube 38 is provided at the nip defined by the open belt 25 and the roll 37 located after the suction boxes 34, 35, said spray tube 38 supplying water to produce a liquid film between the roll and belt. A pipe 39 for blowing air is disposed outside the loop, immediately before the last roll 40, before the belt 25 reaches the guide roll 14. The water from the water spray tubes 33 and 38 is collected in a trough 41.

The drying section 2 may also include means for IR heating of the paper web 7. An IR hood 45 may be disposed, for instance, at a point on the yankee cylinder 12 where the paper web is exposed between press roll 15 and said drying hood covering the yankee cylinder 12. One or more IR hoods 46 may also be disposed between the pick-up roll 14 and the press roll 15 to IR heat the paper web while this forms the intermediate layer of the sandwich structure.

In its second operating arrangement according to FIG. 2, the paper machine may be provided with a press felt (not shown) moving in a loop, said press felt being arranged inside the loop of belt 25 or the carrying forming wire 4*a*, running around a press roll, not shown, pressing against one side of the sandwich structure and an opposite press roll, not shown, which may also be wrapped by such an inner press felt. If desired such an inner press loop, arranged inside the loop of the belt 25 may be extended to also run around the press roll 15.

Since the belt 25 is perforated or open, i.e. provided with a great number of through-holes running in the thickness direction of the paper web 7, it will function as an embossing belt so that when the paper web 7 passes the nip between press roll 15 and yankee cylinder 12, parts of it will be pressed into these holes, thus producing a relief pattern. These parts of the paper web pressed into the holes will not be subjected to any appreciable pressure, thus contributing to higher bulk and softness.

The paper machine described can easily be changed to the different operating arrangements in order to manufacture soft crepe paper webs of different qualities with respect to bulk and softness, in dependence of the varying conditions prevailing on the market at the moment. These conditions may quickly change from one time to another. Furthermore, the extra drying devices placed within the range of the sandwich structure in the second operating arrangement, enable increased dry solids content to be achieved before the yankee cylinder so that the paper machine can be run at increased speed which is at least substantially equivalent to the speed of through drying machines mentioned in the introduction.

Figure 3:
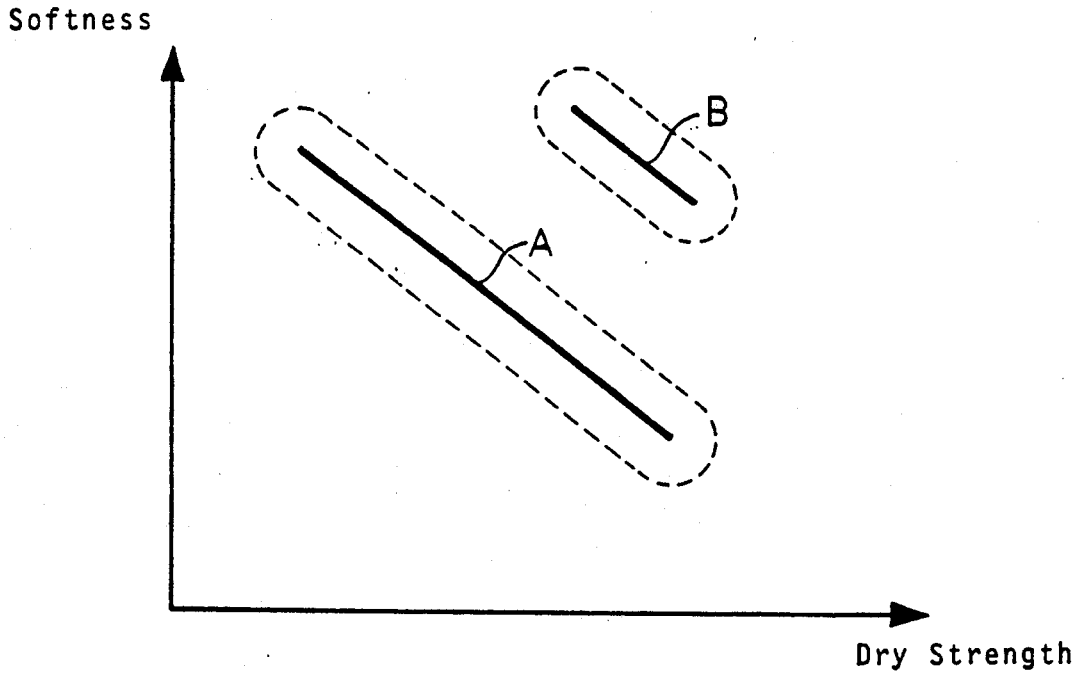
FIG. 3 is a diagram showing the relation between drying strength and softness for soft crepe paper webs produced according to the two different operating arrangements.

FIG. 3 illustrates the relation between dry strength and softness. The line A indicates average values for soft crepe paper web produced using the conventional first arrangement of the paper machine. It is clear that a desired increased strength results in reduced softness. Conversely a desired increased softness results in reduced strength of the soft crepe paper web. Line B indicates average values for soft crepe paper web produced using the second operating arrangement of the paper machine according to the present invention. Thus, it is clear that within a desired range for the strength of the soft crepe paper web, higher softness is obtained in relation to soft crepe paper web produced using the paper machine in its conventional arrangement.

The invention has been described in connection with a twin wire machine, however, it can also be applied to a fourdrinier machine in which the supporting forming wire, i.e. the fourdrinier wire, is extended up to the yankee cylinder in the same way as the carrying forming wire 4a in the twin wire machine described.

We claim:

1. A paper machine for manufacturing a soft crepe paper web, comprising a headbox; a drying cylinder; a press roll cooperating with said drying cylinder to define a nip through which the paper web passes; a forming wire arranged to run in an extended endless loop from said headbox to said press roll; an air and liquid permeable perforated belt arranged to run in an endless loop passing around said press roll; a pick-up roll positioned within the endless loop of said perforated belt to guide the belt into contact with the forming wire at a location between said headbox and said press roll so that the forming wire and the permeable belt continuously sandwich the paper web therebetween along a distance from the pick-up roll to the press roll; at least one suction means and at least one steam blow nozzle, the suction means and steam blow nozzle being disposed opposite each other on opposite sides of the paper web and cooperating with said forming wire and said permeable belt in the region between said pick-up roll and said press roll for directing jets of air through said forming wire and said permeable belt and through the paper web sandwiched therebetween to remove water from the paper web; a guide roll disposed within the endless forming wire adjacent to the press roll and positioned so that the forming wire and the permeable belt, with the paper web sandwiched therebetween, wraps a predetermined sector of the press roll before the forming wire separates from the paper web; suction means disposed within said sector of said press roll to facilitate transfer of the paper web to said belt, with the belt and the paper web carried thereon thereafter passing through said nip, and cleaning means cooperating with the loop of said permeable belt between said press roll and said pick-up roll for cleaning the belt so that the permeability to water and air is maintained.

2. A paper machine as claimed in claim 1 wherein said cleaning means includes a water spray for washing the air and liquid permeable perforated belt.

3. A paper machine as claimed in claim 2 wherein said water spray is located inside the loop of said perforated belt, and including at least suction box cooperating with the perforated belt downstream from the water spray for removing water from the perforated belt.

4. A paper machine as claimed in claim 3 wherein the water spray is located in a portion of the endless loop disposed above the paper web, and including a trough for collecting water from the water spray.

5. A paper machine as claimed in claim 1 including at least one blow nozzle directed toward the suction means in said press roll.

6. A paper machine for manufacturing a soft crepe paper web, comprising a headbox; a drying cylinder; a press roll cooperating with said drying cylinder to define a nip through which the paper web passes; a forming wire arranged to run in an extended endless loop from said headbox to said press roll; an air and liquid permeable perforated belt arranged to run in an endless loop passing around said press roll; a pick-up roll positioned within the endless loop of said perforated belt to guide the belt into contact with the forming wire at a location between said headbox and said press roll so that the forming wire and the permeable belt continuously sandwich the paper web therebetween along a distance from the pick-up roll to the press roll; a first suction box cooperating with said forming wire at a location downstream from said pick-up roll, a second suction box and a cooperating steam blow nozzle, said second suction box and steam blow nozzle being disposed opposite each other on opposite sides of the paper web and located downstream from said first suction box and cooperating with said forming wire and said permeable belt for directing jets of air through said forming wire and said permeable belt and through the paper web sandwiched therebetween to remove water from the paper web; a guide roll disposed within the endless forming wire adjacent to the press roll and positioned so that the forming wire and the permeable belt, with the paper web sandwiched therebetween, wraps a predetermined sector of the press roll before the forming wire separates from the paper web; suction means disposed within said sector of said press roll to facilitate transfer of the paper web to said belt, with the belt and the paper web carried thereon thereafter passing through said nip, and cleaning means cooperating with the loop of said permeable belt between said press roll and said pick-up roll for cleaning the belt so that the permeability to water and air is maintained.

7. A paper machine as claimed in claim 6 including at least one additional suction box cooperating with said forming wire between said headbox and said pick-up roll.

8. A paper machine as claimed in claim 6 including at least one IR hood disposed at the drying cylinder for heating the paper web on the drying cylinder.

9. A paper machine as claimed in claim 6 including at least one IR hood disposed for heating the paper web between the pick-up roll and the press roll.

10. A paper machine for manufacturing a soft crepe paper web, comprising a forming roll; a forming wire arranged to run in an extended endless loop around said forming roll; an endless loop covering wire arranged to run over the forming roll and said forming wire; a headbox arranged for supplying stock between said forming wire and said covering wire; a press roll located at a distance from said forming roll, said forming wire extending from said forming roll to said press roll and arranged to pass over said press roll; an air and liquid permeable perforated belt arranged to run in an endless loop passing around said press roll; a pick-up roll positioned within the endless loop of said perforated belt to guide the belt into contact with the forming wire at a location between said headbox and said press roll so that the forming wire and the permeable belt continuously sandwich the paper web therebetween along a distance from the pick-up roll to the press roll; a first suction box cooperating with said forming wire at a location downstream from said pick-up roll; a plurality of additional suction boxes located downstream from said first suction box and cooperating with said forming wire and said permeable belt; a steam blow nozzle cooperating with at least one of said additional suction boxes and being disposed on the opposite side of the paper web from said additional suction box for directing air through said forming wire and said permeable belt and through the paper web sandwiched therebetween to remove water from the paper web; a guide roll disposed within the endless forming wire adjacent to the press roll and positioned so that the forming wire and the permeable belt, with the paper web sandwiched therebetween, wraps a predetermined sector of the press roll before the forming wire separates from the paper web; a yankee drying cylinder disposed adjacent said press roll and cooperating therewith to form a nip through which the paper web passes for being transferred to the yankee cylinder; suction means disposed within said sector of said press roll to facilitate transfer of the paper web to said belt, with the belt and the paper web carried thereon thereafter passing through said nip, and cleaning means cooperating with the loop of said permeable belt between said press roll and said pick-up roll for cleaning the belt so that the permeability to water and air is maintained.

* * * * *